US006594965B2

(12) United States Patent
Coulton

(10) Patent No.: US 6,594,965 B2
(45) Date of Patent: Jul. 22, 2003

(54) SPACER FOR PROVIDING DRAINAGE PASSAGEWAYS WITHIN BUILDING STRUCTURES

(75) Inventor: Michael S. Coulton, Lansdale, PA (US)

(73) Assignee: Benjamin Obdyke Incorporated, Horsham, PA (US)

( * ) Notice: Subject to any disclaimer, the term of this patent is extended or adjusted under 35 U.S.C. 154(b) by 0 days.

(21) Appl. No.: 09/934,240

(22) Filed: Aug. 21, 2001

(65) Prior Publication Data

US 2003/0037499 A1 Feb. 27, 2003

(51) Int. Cl.[7] ..... E04B 1/70

(52) U.S. Cl. ..... 52/302.1; 52/302.3; 52/741.3; 52/748.11

(58) Field of Search ..... 52/302.1, 302.3, 52/169.14, 741.3, 748.11

(56) References Cited

U.S. PATENT DOCUMENTS

| | | | | |
|---|---|---|---|---|
| 2,339,220 A | | 1/1944 | Crowley | |
| 2,804,657 A | * | 9/1957 | Munters | 52/302.3 |
| 3,313,072 A | * | 4/1967 | Cue | 52/302.3 |
| 3,318,056 A | * | 5/1967 | Thompson | 52/302.3 X |
| 4,315,392 A | | 2/1982 | Sylvest | |
| 4,515,840 A | | 5/1985 | Gatward | 428/35 |
| 4,538,388 A | | 9/1985 | Friesen | |
| 4,805,367 A | | 2/1989 | Kleckner | |
| 5,099,627 A | | 3/1992 | Coulton et al. | |
| 5,383,314 A | | 1/1995 | Rothberg | |
| 5,489,462 A | | 2/1996 | Sieber | |
| 5,598,673 A | | 2/1997 | Atkins | |
| 5,651,734 A | | 7/1997 | Morris | |
| 5,673,521 A | | 10/1997 | Coulton et al. | |
| 5,826,390 A | | 10/1998 | Sacks | |
| 5,860,259 A | | 1/1999 | Laska | |
| 5,888,614 A | | 3/1999 | Slocum et al. | |
| 5,902,432 A | | 5/1999 | Coulton et al. | |
| 5,960,595 A | | 10/1999 | McCorsley, III et al. | |
| 6,131,353 A | | 10/2000 | Egan | |
| 6,233,890 B1 | | 5/2001 | Tonyan | |
| 6,355,333 B1 | | 3/2002 | Waggoner et al. | |

FOREIGN PATENT DOCUMENTS

| | | |
|---|---|---|
| JP | 60-124419 | 8/1985 |
| JP | 01-083805 | 6/1989 |

OTHER PUBLICATIONS

Dryvit Systems, Inc., "Residential MD System®", includes: 6 pages of Specifications, 3 pages of Installation Details, and 13 pages of Application Instructions, Apr. 2000.

Senergy, "Senturion III Senergy® QR–CDsystem Exterior Insulation and Finish System", 9 pages, Oct. 1998.

Enka–Engineered Building Products, "Enkamat®","Enkadrain®" & "Enkatherm™", 4 pages from Internet web site, date unknown.

American Wick Drain Corporation, "CedarSaver Vent for Wood Shingles and Shakes", 2 pages from Internet web site, date unknown.

Brochure of KO Sangyo Co., Ltd., "Rib Sheet", 1988 (month unknown), English translation included.

* cited by examiner

*Primary Examiner*—Laura A. Callo
(74) *Attorney, Agent, or Firm*—Howson and Howson

(57) ABSTRACT

A roll-form spacer product providing air space and drainage passageways within a building structure. Preferably, the spacer product is a corrugated web of material having undulating front and rear faces and serpentine-shaped longitudinally extending edges. The faces include alternating arrays of grooves and ridges which extend perpendicular to the side edges and parallel to an axis of a spiral roll of the spacer. Thus, when the spacer is unrolled and applied to a building structure in a plurality of horizontally extending rows, the ridges and grooves are substantially vertically-disposed to form a plurality of unobstructed passageways for the drainage of moisture. Preferably, the web is made of an openwork mat of randomly convoluted polymeric filaments, and thus, enables ready circulation of air.

37 Claims, 3 Drawing Sheets

FIG.1
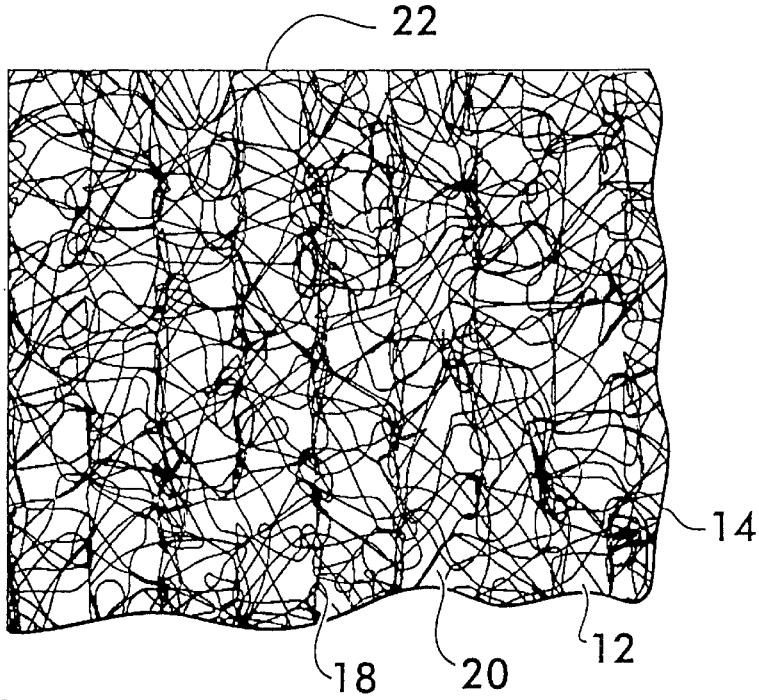
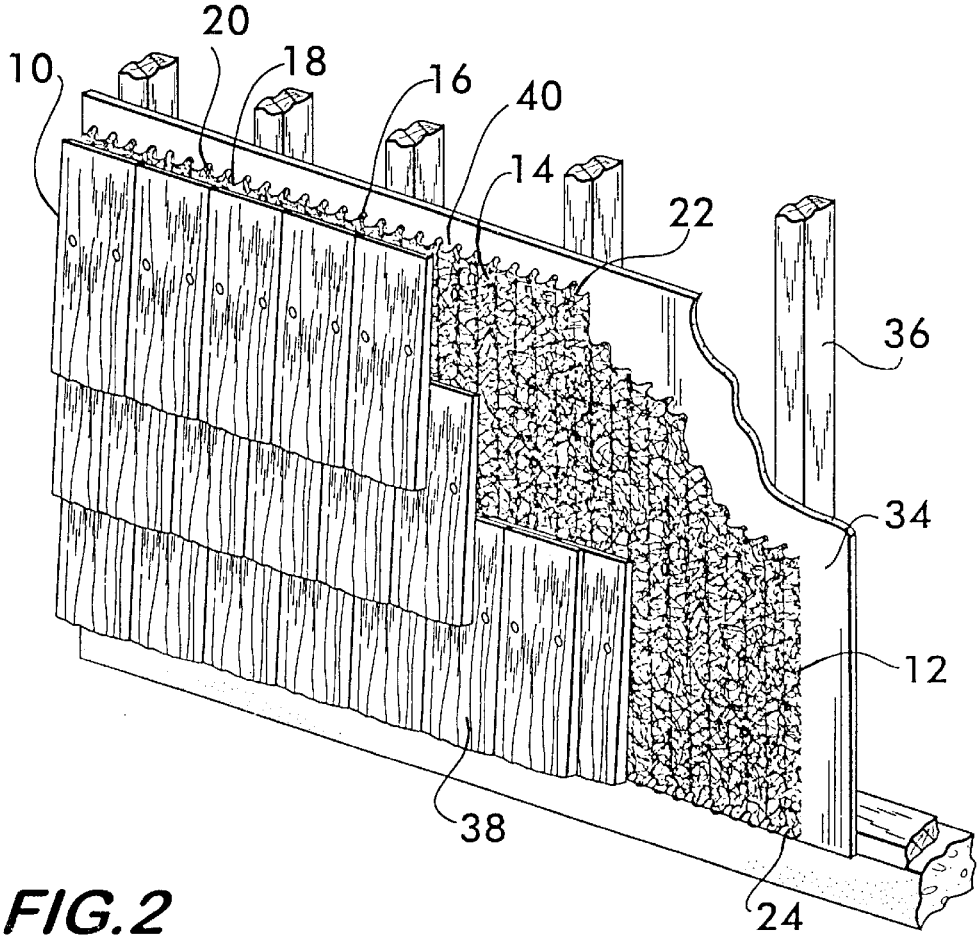
FIG.2

SPACER FOR PROVIDING DRAINAGE PASSAGEWAYS WITHIN BUILDING STRUCTURES

FIELD OF THE INVENTION

The present invention relates to the formation of drainage and ventilation passageways within a building structure to prevent the accumulation of moisture within the building structure, and more particularly, the present invention relates to a spacer, a building structure assembled with the spacer, and a method of assembling a building structure with the spacer such that the spacer provides substantially vertically-disposed, continuous, unobstructed drainage paths adjacent an inner sheathing member and an outer building material of the structure.

BACKGROUND OF THE INVENTION

Moisture which accumulates within a building structure, such as an exterior wall of a building, will cause premature deterioration of the building structure. To avoid the accumulation of moisture, it has previously been recommended to provide ventilation and/or drainage passageways between an inner sheathing member and an outer building material of the building structure.

Entrapped moisture is particularly a problem on wall structures of buildings covered with a house-wrap product. Typical house-wraps utilized in building constructions are engineered to permit one-way passage of vapor therethrough so that moisture vapor can escape the building but cannot enter the building. Vapor which is permitted to pass through house-wrap must be provided with a drainage path through the remainder of the wall; otherwise, condensation will form and become entrapped within the wall.

One known building component for use in providing a path of ventilation in a roof or wall of a building structure is disclosed in U.S. Pat. No. 5,099,627 which issued to Coulton et al. and which is assigned to Benjamin Obdyke, Inc., the assignee of the present application. According to the Coulton patent, an openwork member is located between an inner sheathing member and an outer building material, such as wooden shingles. The openwork member provides vapor flow paths therethrough to prevent moisture from becoming entrapped adjacent the inner sheathing member and adjacent the outer building material. As disclosed in the '627 patent, the preferred embodiment of an openwork member is made of a resilient matrix of matted self-supporting filaments providing multiple vapor flow paths therethrough.

Other building products are known which are provided in a corrugated shape. For example, U.S. Pat. No. 5,826,390 issued to Sacks discloses a vapor permeable membrane having spacers thereon for the purpose of providing drainage passageways within a wall of a building. For instance, FIG. 4 of the Sacks patent discloses a vapor permeable membrane having corrugated spacer elements attached at regular intervals on the membrane, and in an embodiment illustrated in FIG. 6, the membrane itself is provided in a corrugated form.

Another corrugated product is disclosed by U.S. Pat. No. 5,888,614 which issued to Slocum et al. and which discloses a multilayer, corrugated house-wrap film for use within the exterior walls of buildings. A further example of a corrugated building component is disclosed by U.S. Pat. No. 2,339,220 which issued to Crowley and which discloses a building panel having a corrugated metal stiffening member sandwiched between outer layers of wooden material.

Other building products for providing drainage and/or ventilation passageways within building structures are disclosed by U.S. Pat. No. 6,131,353 issued to Egan; U.S. Pat. No. 5,860,259 issued to Laska; U.S. Pat. No. 6,233,890 issued to Tonyan; U.S. Pat. No. 5,598,673 issued to Atkins; U.S. Pat. No. 4,805,367 issued to Kleckner; U.S. Pat. No. 4,538,388 issued to Friesen; U.S. Pat. No. 4,315,392 issued to Sylvest; U.S. Pat. No. 5,489,462 issued to Sieber; and U.S. Pat. No. 5,383,314 issued to Rothberg. The Egan patent discloses a drainage mat including a vapor permeable membrane and an openwork mat of filaments having a waffle-like structure. The Laska patent discloses an insulated cuspated sheet of plastic for use in providing open drainage paths behind masonry walls. The Tonyan patent discloses a weather resistive membrane having an attached mesh material which provides open spaces for the flow of moisture downwardly within a wall structure. The Atkins patent discloses a layer of mesh material providing drainage pathways behind an exterior masonry wall. The Kleckner patent discloses a rigid undulating support for providing ventilation between roof insulation board and a roof deck. The Friesen patent discloses a double-sided cuspated plastic sheet material for use in providing ventilation pathways within a flat roof. The Sylvest patent discloses a roof covering sheet material including a layer of openwork mat. The Sieber patent discloses a double-sided cuspated plastic sheet material for use between the ground and a building foundation for providing protective, ventilation, heat-insulating, and drainage functions, and the Rothberg patent discloses a cuspated plastic sheet drainage mat for roofs and decks.

Certain building products are provided in a spiral roll to enable efficient storage and transportation. Such products are generally referred to as so-called roll-form products. For example, U.S. Pat. Nos. 5,902,432 and 5,673,521 which issued to Coulton et al. and which are assigned to Benjamin Obdyke, Inc. disclose roof ridge vents provided as elongate, roll-form, sheet-like, thermoplastic webs of material. Also see U.S. Pat. No. 5,960,595 issued to McCorsley, III et al. which discloses a roll-form roof ridge vent constructed of an openwork mat, and U.S. Pat. No. 5,651,734 issued to Morris which discloses a roll-form roof ridge vent made of a blank of corrugated plastic sheet material.

Although the drainage and/or ventilation mats and the like disclosed in the above referenced patents may function satisfactorily for their intended purposes, there remains a need for an inexpensive roll-form spacer product made of an elongate web of material which can be utilized in a wall and/or roof construction to provide continuous, unobstructed, vertically-disposed drainage paths and ventilation air spaces between an inner sheathing member and an outer building material. The spacer should permit ready installation requiring only a minimum of skill and should provide drainage and/or ventilation paths along both the inner sheathing member and the outer building material. Preferably, the spacer product also provides ventilation paths transversely through the web and can be inexpensively manufactured requiring only a minimum of material.

OBJECTS OF THE INVENTION

With the foregoing in mind, a primary object of the present invention is to provide an efficient and economical spacer product which is capable of being readily installed in a wall or roof structure between an inner sheathing member and an outer building material and which provides continuous, unobstructed, vertically-disposed drainage passageways adjacent both the inner sheathing member and the outer building material.

Another object of the present invention is to provide a building structure having continuous, unobstructed, vertically-disposed drainage paths therein which prevent moisture from becoming entrapped within the structure.

A further object of the present invention is to provide a method of assembling a building structure which ensures that continuous and unobstructed drainage paths are vertically-disposed adjacent both an inner sheathing member and an outer building material.

SUMMARY OF THE INVENTION

More specifically, the present invention is a spacer utilized to provide drainage paths and air space within a building structure thereby preventing deterioration of the building structure due to trapped moisture. The spacer is a continuous, indeterminate-length, roll-form, corrugated web of material which has an undulating front face, a corresponding undulating rear face, and a pair of serpentine-shaped, longitudinally-extending side edges. The corrugated web is capable of being rolled lengthwise into a spiral roll about an imaginary central axis during manufacture and being unrolled lengthwise during installation, and each of the undulating front and rear faces have an alternating array of ridges and grooves which extend continuously from one side edge to the other. When the corrugated web is unrolled laterally on the building structure for installation on the building structure, the grooves on the front and rear faces provide substantially vertically-disposed, continuous, unobstructed drainage paths. Preferably, the side edges are substantially parallel, and the ridges and grooves extend substantially perpendicular to the side edges and substantially parallel to the imaginary central axis of the spiral roll. In addition, the preferred embodiment of the web is an openwork mat of randomly convoluted polymeric filaments.

According to another aspect of the present invention, a building structure is provided having drainage passageways and air spaces therein to prevent moisture from being trapped and to retard deterioration. To this end, the building structure includes an inner sheathing member, an outer building material, and an elongate corrugated web of material located therebetween for providing drainage passageways and air spaces therein. The corrugated web has an undulating front face, a corresponding undulating rear face, and a pair of longitudinally-extending side edges each having a serpentine configuration. The pair of side edges are substantially parallel and are installed in the building structure such that they extend substantially parallel with the horizontal. Each of the undulating front and rear faces have an alternating array of ridges and grooves which extend continuously from one of side edge to the other such that the grooves on the front and rear faces provide substantially vertically-disposed, continuous, unobstructed drainage paths within the building structure.

According to yet another aspect of the present invention, a method of assembling a building structure is provided. A spiral roll of an elongate corrugated web of material is provided adjacent an installed inner sheathing member of a building structure. The web has an undulating front face, a corresponding undulating rear face, and a pair of serpentine-shaped, longitudinally-extending side edges, and each of the undulating front and rear faces have an alternating array of ridges and grooves which extend continuously from one side edge to the other. The web is unrolled in a lengthwise direction horizontally on the sheathing and secured to the sheathing such that the rear face of the web faces the sheathing and the side edges of the web extend substantially parallel to the horizontal. Thus, the grooves on the front and rear faces of the web provide substantially vertically-disposed, continuous, unobstructed drainage paths within the building structure.

BRIEF DESCRIPTION OF THE DRAWINGS

The foregoing and other objects, features and advantages of the present invention should become apparent from the following description when taken in conjunction with the accompanying drawings, in which:

FIG. 1 is an elevation view of a portion of an undulating front face of a spacer according to the present invention;

FIG. 2 is a perspective view of a wall construction for a building utilizing the spacer according to the present invention;

DETAILED DESCRIPTION OF THE PREFERRED SPACER

Figure 3:
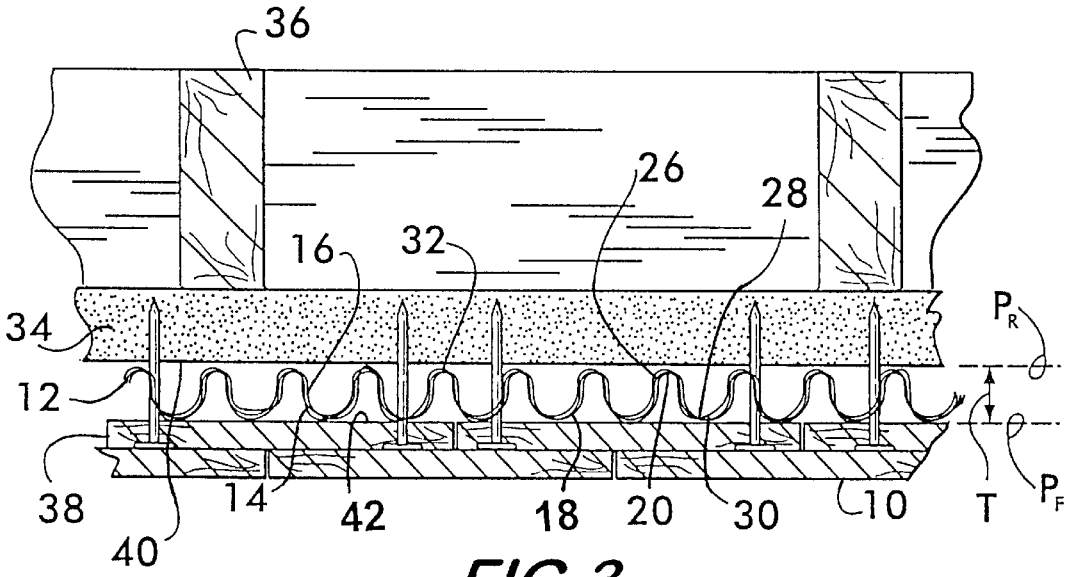
FIG. 3 is a cross-sectional view of the sidewall illustrated in FIG. 2 taken along a plane parallel to the horizontal.

Referring now to the drawings, FIG. 2 illustrates a wall 10 of a building structure assembled with a spacer 12 according to the present invention. The installed spacer 12 provides ventilation and drainage passageways which enables the free flow of air, vapor and liquids adjacent, and transversely between, the opposite sides of the spacer 12 to ensure that moisture is prevented from accumulating within the wall 10 on either side of the spacer 12. Preferably, the drainage paths provided by the spacer 12 are continuous, unobstructed, and vertically-disposed so that liquid moisture is permitted to descend within the wall under the force of gravity in an unobstructed free path to an exit provided at the base of the wall.

As illustrated in FIGS. 1–5, the preferred structure of the spacer 12 is an elongate, corrugated openwork mat of randomly convoluted polymeric filaments. To this end, the spacer 12 is made of a thin layer of randomly convoluted polymeric filaments that is shaped into a corrugated form during manufacture to provide a corrugated openwork mat having a relatively significant thickness "T" despite containing very little material, i.e., polymeric filaments. For instance, the weight of the polymeric filament material in a preferred embodiment of a corrugated openwork mat is within a range of about 4.0 ounces to about 8.0 ounces per square yard of the openwork mat. In addition, the corrugated structure of the openwork mat enables it to be made form a minimum of material yet still provide an elastically compressible spacer 12 that has a suitable compression strength to operate in about a 100 to about a 200 pounds per square foot (psf) environment. Preferably, the spacer 12 compresses no more than about 30% of its original thickness when it is subjected to 100 to 200 psf of pressure. Thus, the corrugated and openwork structure of the spacer 12 enables the ventilation/drainage paths to be relatively open and unobstructed and enables the spacer 12 to be made of a minimum of material thereby significantly decreasing material costs incurred in the manufacture of the spacer 12.

Structurally, the spacer 12 includes a front face 14 with a wavy or undulating surface and a rear face 16 with a corresponding wavy or undulating surface. The surface of the front face 14 is provided with an alternating array of ridges 18 and grooves 20 that extend continuously from one longitudinally-extending side edge 22 to an opposite longitudinally-extending side edge 24, and the surface of the rear face 16 is provided with an alternating array of ridges 26 and grooves 28 that extend continuously from the side edge 22 to the opposite side edge 24. The pair of side edges, 22 and 24 define the height "H" of the faces, 14 and 16, and have a serpentine or sinuous shape as best illustrated in FIG. 3.

Figure 4:
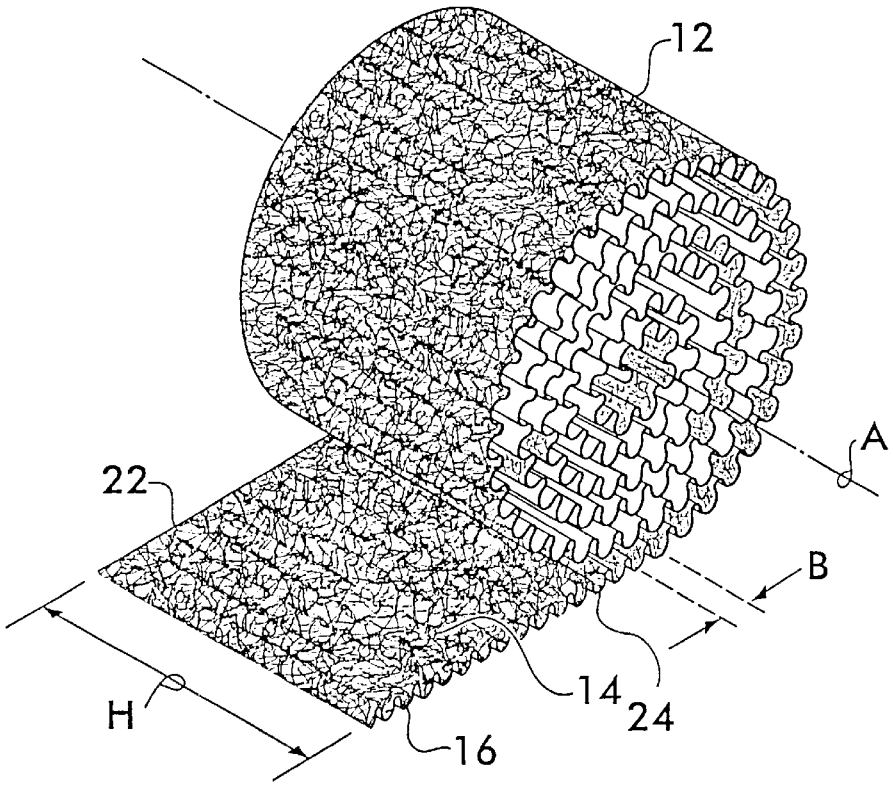
FIG. 4 is a perspective view of a spiral roll of the spacer illustrated in FIG. 1.

As illustrated in FIG. 4, the spacer 12 is conveniently and efficiently stored and transported in roll-form in which the spacer 12 is rolled in a spiral about an imaginary central axis "A". Importantly, as best illustrated in FIG. 4, the ridges and grooves, 18, 20, 26 and 28, extend substantially parallel to axis "A" and substantially perpendicular to the parallel side edges, 22 and 24. Thus, when unrolled laterally across a vertical wall and installed on the wall, the grooves, 20 and 28, in the front and rear faces, 14 and 16, are vertically disposed thereby providing a plurality of continuous, vertical paths for the unobstructed downward flow of liquid moisture within the wall. For instance, see the direction in which the grooves, 20 and 28, extend in the exposed portion of spacer 12 in the bottom-right portion of FIG. 2.

The importance of the above stated directionality of the grooves, 20 and 28, can perhaps best be understood in contrast to a spacer (not shown) having grooves extending parallel to its side edges. To this end, the grooves and ridges of an installed spacer would extend horizontally in the wall, and any moisture dripping downwardly within the wall would contact each ridge in its downward path. This contact slows the descent of the moisture and aids in extending the period of time of retention of a portion of the moisture on the spacer and/or between the ridges of the spacer and a confronting building structure surface. Alternatively, such a spacer product could be pre-cut into finite length strips which would be vertically positioned and secured to a wall so that the grooves are vertically-disposed in the wall. However, such a process would require securing the spacer at the top of a wall, unrolling it to the base of wall, and securing it along its length at various vertically-spaced elevations. Such a process would be awkward and time and labor intensive as compared to the spacer of the present invention which is properly oriented when simply unrolled horizontally on the wall and secured along a given constant elevation.

By way of example, and not by way of limitation, the spacer 12 according to the present invention is provided having a length of about 30 to 120 feet, when unrolled, and a height "H" between its side edges, 22 and 24, of about three to eight feet. Preferably, each groove 20 on the front face 14 of the corrugated openwork mat is of a substantially uniform size and shape and each ridge 18 on the front face 14 is of a substantially uniform size and shape. The same is true of the grooves 28 and ridges 26 of the rear face 16. The grooves and ridges on both faces, 14 and 16, can be formed of an identical size and shape, or the size and shape of the grooves and ridges can vary within different lengths of the spacer. The shape of the transverse cross-section of the corrugated spacer can resemble a saw-tooth pattern, a sine-wave pattern, or any other serpentine or undulating shape.

When the mat is unrolled into a substantially planar condition, each of the ridges 18 on the front face 14 has an apex 30 which extends to a common front imaginary plane "$P_F$" and each ridge 26 on the rear face 16 has an apex 32 which extends to a common rear imaginary plane "$P_R$" which extends parallel to the front imaginary plane "$P_F$" The thickness "T" of the mat is defined as the distance between the front and rear imaginary planes, "$P_F$" and "$P_R$" Preferably, the thickness "T" is in a range of about ⅛ (one-eighth) to about ¾ (three-fourths) inch, and each adjacent pair of apexes 30 on the front face 14 and each adjacent pair of apexes 32 on the rear face 16 are spaced-apart a distance "B" of about ⅛ (one-eighth) to about ¾ (three-fourths) inch.

If not all the advantages provided by an openwork mat are required, the spacer can be a similarly constructed corrugated solid sheet of thermoplastic material (not shown). If desired, the corrugated web of thermoplastic material can be perforated having a series of ventilation apertures at predetermined spaced distances to permit a transverse path of ventilation through the otherwise solid sheet spacer. The thermoplastic material can be, for instance, high impact polystyrene (HIPS), ABS, high-density polyethylene (HDPE), high-density polypropylene (HDPP), PVC, or a blend of any of these suitable polymers and can be shaped by thermoforming, vacuum stamping, or any other suitable technique.

DETAILED DESCRIPTION OF THE PREFERRED BUILDING STRUCTURE

The wall 10 illustrated in FIGS. 2 and 3 includes an upright planar inner sheathing member 34 which is affixed to support posts 36. The inner sheathing member 34 is typically formed of panels of plywood, panels of oriented strand board, panels of particle board, an insulated concrete wall, or other materials permitted by local building codes. In some instances, the inner sheathing member 34 is lined with a membrane (not shown), such as a one-way vapor permeable house-wrap. Examples of other membranes include asphalt impregnated felt and building paper.

During construction, the spacer 12 is unrolled laterally on the inner sheathing member 34 such that the rear face 16 of the spacer 12 faces the inner sheathing member 34 and/or membrane, and the side edges 22 and 24 of the spacer 12 extend substantially parallel with the horizontal. Thereafter, an outer building material 38 is affixed to the inner sheathing member 34 such that it overlies the spacer 12 and sandwiches the spacer 12 between the inner sheathing member 34 and the outer building material 36. The outer building material 36 can be, for instance, a siding material such as a wood or fiber-cement siding product. Of course, other outer building materials can also be utilized, such as, brick, vinyl materials, stucco, exterior insulation finish systems (EIFS) or other siding materials.

As best illustrated in FIG. 3, the apexes 32 of the ridges 26 of the rear face 16 engage the inner sheathing member 34, or membrane, and the apexes 30 of the ridges 18 of the front face 14 are spaced a distance "T" therefrom and engage the outer building material 38. Thus, a plurality of continuous and vertically-disposed drainage paths, or runways, 40 extend adjacent the inner sheathing member 34 between each adjacent pair of ridges 26, and a plurality of continuous and vertically-disposed drainage paths, or runways, 42 extend adjacent the outer building material 38 between each adjacent pair of ridges 18. Any moisture which collects on the surface of either the inner sheathing member 34 or membrane, and the outer building material 38 adjacent the spacer 12 is provided with a free unobstructed path to drain downwardly and out of the wall. The multitude of apertures formed in the openwork mat enable the free circulation of air between the inner sheathing member 34 and outer building material 38 and aid in the drying, or evaporation, of any moisture which is present within the wall 10.

Figure 5:
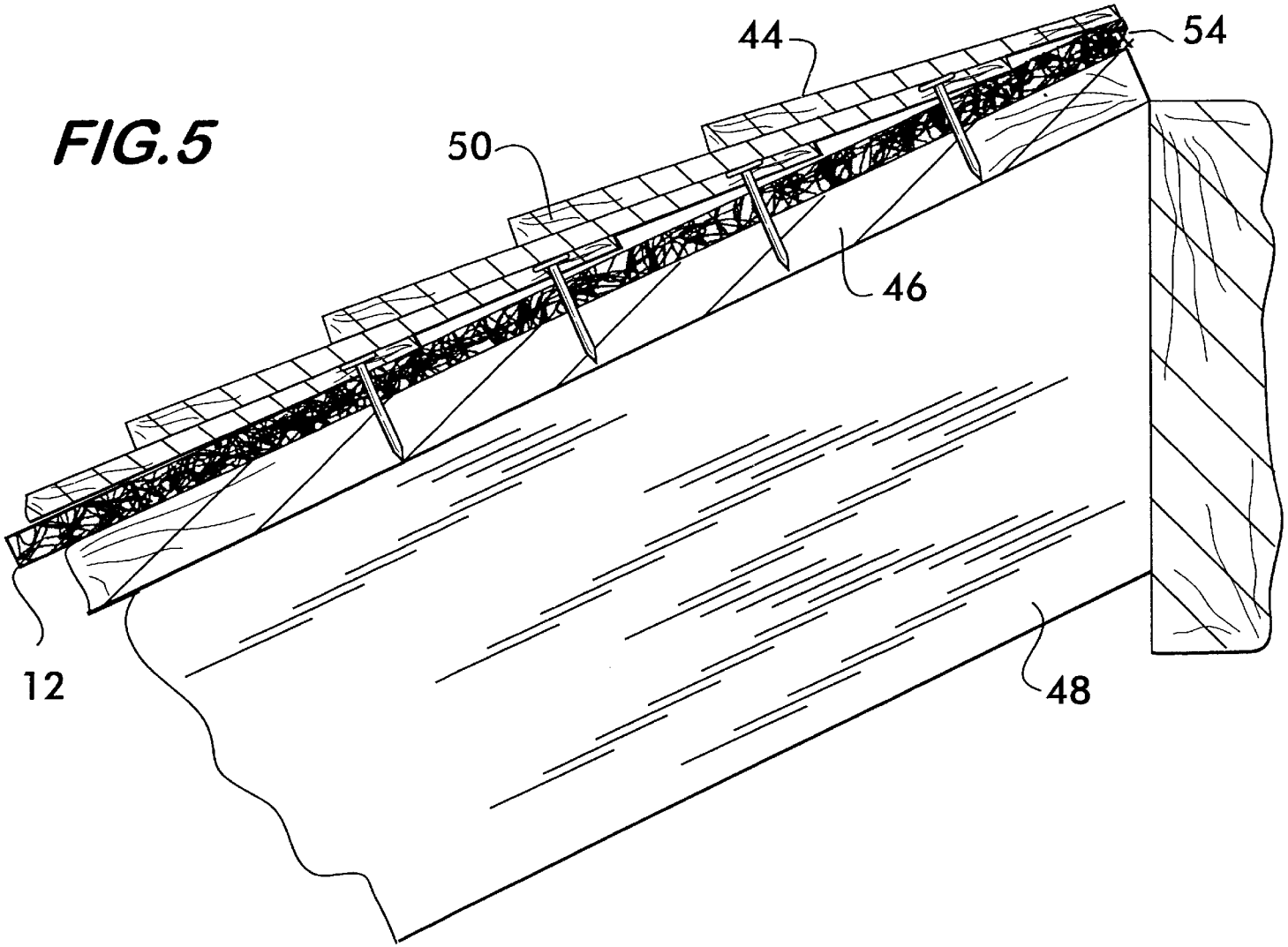
FIG. 5 is a perspective view of a roof construction for a building according to the present invention.

The spacer 12 according to the present invention can also be utilized in roof constructions. As illustrated in FIG. 5, the inclined roof structure 44 includes an inner sheathing member, in this case a deck member 46, which is affixed to rafters 48. The deck member 46 is typically made of plywood, particle board or other materials permitted by local building codes and is typically lined with a membrane, in this case a layer of roofing felt (not shown).

During assembly of the roof 44, the spacer product 12 is unrolled lengthwise over the roofing felt in a direction parallel with the peak 46 of the roof 40 and is secured to the deck member 42 with nails, staples, adhesives or the like. The rear face 16 of the spacer 12 faces the roofing felt and the deck member 42, and the side edges, 22 and 24, of the spacer 12 are vertically offset and extend substantially parallel with the horizontal. Thereafter, an outer building material 50 is affixed to the deck member 46 such that it overlies the spacer 12. As illustrated, the outer building material 50 is wooden shingles, such as cedar shakes. Of course, other outer building materials can also be utilized, such as, metal roofing materials.

The apexes 32 of ridges 26 of the rear face 16 of the spacer 12 engage the roofing felt and the apexes 30 of the ridges 18 of the front face 14 engage the outer building material 50. Thus, a plurality of unobstructed and continuous inclined drainage paths, or runways, extend from adjacent the peak 54 of the roof 44 to a lower edge of roof 44. Any vapors which enter the roof 44 will be vented via the circulation of air through the spacer 12, and any rain water which leaks into the roof 44 will be provided with a free unobstructed inclined drainage path to trickle downwardly and out of the roof structure 44. In addition, the multitude of apertures in the openwork mat aids in the free flow of air within the spacer and the drying, or evaporation, of any moisture present in the roof 40.

DETAILED DESCRIPTION OF THE PREFERRED METHOD

Another aspect of the present invention relates to a method of assembling a building structure such as the wall 10 illustrated in FIG. 2 or the roof 44 illustrated in FIG. 5. To this end, an inner sheathing member of the building structure is installed utilizing known techniques. In some instances, the inner sheathing member is then lined with a membrane (not shown), such as, a one-way vapor permeable house-wrap, an asphalt impregnated felt, or a building paper. Thereafter, a spiral roll of spacer 12 is located adjacent the inner sheathing member/membrane and unrolled laterally across the inner sheathing member/membrane such that the rear face 16 of the spacer 12 faces and/or confronts the inner sheathing member/membrane, and the side edges, 22 and 24, of the spacer 12 extend substantially parallel to the horizontal. The spacer 12 is secured to the inner sheathing member and additional rows of spacer 12 are secured to the inner sheathing member until the entire inner sheathing member/membrane is covered by a single layer of the spacer 12. Thereafter, an outer building material is applied over the spacer 12.

An important aspect of the present invention is that the spacer 12 is applied in substantially horizontal rows and that the grooves and ridges of the corrugated spacer 12 extend substantially vertically within a wall, or along the direction of incline within an inclined roof. Preferably, the grooves and ridges in adjacent rows of the spacer 12 are aligned to provide a continuous groove and/or ridge throughout the entire elevation of the building structure. In this way, the grooves and ridges on the front and rear faces of the spacer will provide substantially vertically-disposed runways providing a free unobstructed path for the flow of liquids down the building structure until the liquid is permitted to exit at the base of the building structure or until the moisture evaporates due to the circulation of air through the spacer 12.

Thus, the above-described spacer, building structure and method of assembly according to the present invention provides a cost effective spacer product for use in providing drainage passageways within wall and roof structures.

While a preferred spacer, building structure, and method of assembly have been described in detail, various modifications, alterations, and changes may be made without departing from the spirit and scope of the spacer, building structure, and method of assembly according to the present invention as defined in the appended claims.

What is claimed is:

1. A spacer for providing drainage paths and air space within a building structure to prevent deterioration of the building structure due to trapped moisture, consisting of:

a continuous, indeterminate-length, roll-form, corrugated web of openwork material;

said corrugated web having an undulating front face, a corresponding undulating rear face, and a pair of serpentine-shaped, longitudinally-extending side edges, and said openwork material having a plurality of openings permitting free passage of air and liquids in both transverse directions therethrough between said front and rear faces;

said corrugated web being rolled lengthwise into a spiral roll about an imaginary central axis during manufacture and being unrolled lengthwise during installation; and each of said undulating front and rear faces having an alternating array of ridges and grooves which extend continuously from one of said side edges to the other of said side edges such that, when said corrugated web is unrolled laterally on the building structure for installation on the building structure, said grooves on said front and rear faces provide substantially vertically-disposed, continuous, unobstructed drainage paths.

2. A spacer according to claim 1, wherein said pair of side edges are substantially parallel, and wherein said ridges and grooves extend substantially perpendicular to said side edges and substantially parallel to said imaginary central axis of said spiral roll.

3. A spacer according to claim 1, wherein, within at least a predetermined length of said corrugated web, each of said grooves are of a substantially uniform size and shape and each of said ridges are of a substantially uniform size and shape.

4. A spacer according to claim 3, wherein, when said web is unrolled into a substantially planar condition, each of said ridges on said front face within said predetermined length has an apex which extends to a common front imaginary plane and each of said ridges on said rear face within said predetermined length has an apex which extends to a common rear imaginary plane, and wherein said front and rear imaginary planes are substantially parallel and are spaced-apart a distance of about ⅛ to about ¾ inch.

5. A spacer according to claim 4, wherein each adjacent pair of said apexes on said upper face within said predetermined length and each adjacent pair of said apexes on said rear face within said predetermined length is spaced-apart a distance of about ⅛ to about ¾ inch.

6. A spacer according to claim 1, wherein said corrugated web is elastically compressible and has a compression strength sufficient to withstand at least about 200 pounds per square foot (psf) of pressure.

7. A spacer according to claim 1, wherein said web is an openwork mat of randomly convoluted polymeric filaments.

8. A spacer according to claim 7, wherein said corrugated openwork mat has about 4.0 to about 8.0 ounces of polymeric filaments per square yard of said openwork mat.

9. A spacer according to claim 1, wherein said web is a perforated corrugated sheet of thermoplastic material.

10. A spacer for providing drainage paths and air space within a building structure to prevent deterioration of the building structure due to trapped moisture, consisting of:

a continuous, indeterminate-length, roll-form, corrugated openwork mat of randomly convoluted polymeric filaments;

said corrugated openwork mat having an undulating front face, a corresponding undulating rear face, and a pair of serpentine-shaped, longitudinally-extending side edges, and said openwork mat having a plurality of openings permitting free passage of air and liquids in both transverse directions therethrough between said front and rear faces;

said corrugated openwork mat being rolled lengthwise into a spiral roll about an imaginary central axis during manufacture and being unrolled lengthwise during installation;

each of said undulating front and rear faces having an alternating array of uniformly-shaped ridges and uniformly-shaped grooves which extend continuously from one of said side edges to the other of said side edges; and said pair of side edges being substantially parallel, and said ridges and grooves extending substantially perpendicular to said side edges and substantially parallel to said imaginary central axis of said spiral roll such that, when said corrugated openwork mat is unrolled laterally on the building structure for installation on the building structure, said grooves on said front and rear faces provide substantially vertically-disposed, continuous, unobstructed drainage paths.

11. A spacer according to claim 10, wherein said corrugated openwork mat is elastically compressible and compresses up to no more than about 30% of its original thickness when subjected to about 100 to about 200 pounds per square foot (psf) of pressure.

12. A spacer according to claim 11, wherein said corrugated openwork mat has about 4.0 to about 8.0 ounces of polymeric filaments per square yard of said openwork mat.

13. A spacer according to claim 12, wherein, when said mat is unrolled into a substantially planar condition, each of said ridges on said front face has an apex which extends to a common front imaginary plane, wherein each of said ridges on said rear face has an apex which extends to a common rear imaginary plane, and wherein said front and rear imaginary planes are substantially parallel and are spaced-apart a distance of about ⅛ to about ¾ inch.

14. A spacer according to claim 13, wherein each adjacent pair of said apexes on said upper face and each adjacent pair of said apexes on said rear face is spaced-apart a distance of about ⅛ to about ¾ inch.

15. A building structure having drainage passageways and air spaces therein to prevent moisture from being trapped within the building structure and to retard deterioration of the building structure, comprising:

an inner sheathing member;

an outer building material; and an elongate corrugated web of openwork material located between said inner sheathing member and said outer building material for providing drainage passageways and air spaces therein to prevent moisture from being trapped between said inner sheathing member and said outer building material;

said corrugated web having an undulating front face, a corresponding undulating rear face, and a pair of longitudinally-extending side edges each having a serpentine configuration, said pair of side edges being substantially parallel and being installed in the building structure such that said side edges extend substantially parallel with the horizontal, and said openwork material having a plurality of openings permitting free passage of air and liquids in both transverse directions therethrough between said front and rear faces; and each of said undulating front and rear faces having an alternating array of ridges and grooves which extend continuously from one of said side edges to the other of said side edges such that said grooves on said front and rear faces provide substantially vertically-disposed, continuous, unobstructed drainage paths within the building structure.

16. A building structure according to claim 15, wherein the building structure forms a wall of a building.

17. A building structure according to claim 15, wherein the building structure forms a roof of a building.

18. A building structure according to claim 15, wherein said web is an openwork mat of randomly convoluted polymeric filaments.

19. A building structure according to claim 18, further comprising a membrane located between said inner sheathing member and said web, and wherein said membrane is selected from the group consisting of a housewrap material, an asphalt impregnated felt, a building paper, a roofing felt, and a vapor permeable membrane that permits moisture to exit through the building structure and blocks moisture from entering through the building structure.

20. A building structure according to claim 18, wherein said outer building material is selected from the group consisting of wood, brick, metal, fiber cement, vinyl siding material, stucco, and exterior insulation finish systems (EIFS).

21. A building structure according to claim 18, wherein said ridges and grooves extend substantially perpendicular to said side edges.

22. A building structure according to claim 21, wherein substantially each of said grooves are of a substantially uniform size and shape and wherein each of said ridges are of a substantially uniform size and shape.

23. A building structure according to claim 22, wherein said corrugated openwork mat has about 4.0 to about 8.0 ounces of polymeric filaments per square yard of said openwork mat.

24. A building structure according to claim 23, wherein said corrugated openwork mat is elastically compressible and compresses up to no more than about 30% of its original thickness when subjected to about 100 to about 200 pounds per square foot (psf) of pressure.

25. A building structure according to claim 24, wherein each of said ridges on said front face has an apex which extends to a common front imaginary plane, wherein each of said ridges on said rear face has an apex which extends to a common rear imaginary plane, and wherein said front and rear imaginary planes are substantially parallel and are spaced apart by a distance of about ⅛ to about ¾ inch.

26. A building structure according to claim 23, wherein each adjacent pair of said apexes on said upper face and each adjacent pair of said apexes on said rear face is spaced apart by a distance of about ⅛ to about ¾ inch.

27. A building structure according to claim 15, wherein said web is a perforated corrugated sheet of thermoplastic material.

28. A method of assembling a building structure, comprising the steps of:

providing a spiral roll consisting of an elongate corrugated web of openwork material adjacent an installed inner sheathing member of a building structure, said web having an undulating front face, a corresponding undulating rear face, and a pair of serpentine-shaped, longitudinally-extending side edges, each of said undulating front and rear faces having an alternating array of ridges and grooves which extend continuously from one of said side edges to the other of said side edges, and said openwork material having a plurality of openings permitting free passage of air and liquids in both transverse directions therethrough between said front and rear faces;

unrolling said web in a lengthwise direction horizontally on said sheathing; and securing said web to said sheathing such that said rear face of said web faces said sheathing and said side edges extend substantially parallel to the horizontal;

said grooves on said front and rear faces providing substantially vertically-disposed, continuous, unobstructed drainage paths within the building structure.

29. A method according to claim 28, wherein said ridges and grooves extend substantially perpendicular to said side edges.

30. A method according to claim 29, wherein said web is an openwork mat of randomly convoluted polymeric filaments.

31. A method according to claim 30, wherein a plurality of horizontally extending rows of said spacer are secured to said inner sheathing member to cover said inner sheathing member, and wherein said grooves and ridges in each adjacent pair of rows are aligned.

32. A method according to claim 30, wherein said corrugated openwork mat is elastically compressible and compresses up to no more than about 30% of its original thickness when subjected to about 100 to about 200 pounds per square foot (psf) of pressure.

33. A method according to claim 32, wherein said corrugated openwork mat has about 4.0 to about 8.0 ounces of polymeric filaments per square yard of said openwork mat.

34. A method according to claim 30, further comprising the step of installing an outer building material over said openwork mat such that said mat is sandwiched between said inner sheathing material and said outer building material.

35. A method according to claim 34, further comprising the step of securing a membrane to said inner sheathing member before securing said web to said inner sheathing member, wherein said membrane is selected from the group consisting of a housewrap material, an asphalt impregnated felt, a building paper, a roofing felt, and a vapor permeable membrane that permits moisture to exit through the building structure and blocks moisture from entering through the building structure.

36. A method according to claim 34, wherein said outer building material is selected from the group consisting of wood, brick, metal, fiber cement, vinyl siding material, stucco, and exterior insulation finish systems (EIFS).

37. A method according to claim 28, wherein said web is a perforated corrugated sheet of thermoplastic material.

* * * * *

UNITED STATES PATENT AND TRADEMARK OFFICE

CERTIFICATE OF CORRECTION

PATENT NO. : 6,594,965 B2
DATED : July 22, 2003
INVENTOR(S) : Coulton

It is certified that error appears in the above-identified patent and that said Letters Patent is hereby corrected as shown below:

Column 10,
Line 64, "claim 23" should read -- claim 25 --.

Signed and Sealed this

Twenty-fifth Day of November, 2003

JAMES E. ROGAN
*Director of the United States Patent and Trademark Office*